US005758831A

United States Patent [19]

Collins et al.

[11] Patent Number: 5,758,831

[45] Date of Patent: Jun. 2, 1998

[54] COMMINUTION BY CRYOGENIC ELECTROHYDRAULICS

[75] Inventors: Kenneth D. Collins, San Diego; Bradley J. Deghuee, Carlsbad; Ronald A. Walrod, Poway, all of Calif.

[73] Assignee: Aerie Partners, Inc., San Diego, Calif.

[21] Appl. No.: 741,941

[22] Filed: Oct. 31, 1996

[51] Int. Cl.[6] ..... B02C 19/18

[52] U.S. Cl. ..... 241/1; 241/23; 241/65; 241/301; 241/DIG. 37

[58] Field of Search ..... 241/DIG. 31, DIG. 37, 241/23, 65, 1, 301

[56] References Cited

U.S. PATENT DOCUMENTS

| | | |
|---|---|---|
| 4,313,573 | 2/1982 | Goldberger . |
| 4,540,127 | 9/1985 | Andres . |
| 4,721,256 | 1/1988 | Lyman . |

OTHER PUBLICATIONS

Carley–MacCauly, et al "Energy Consumption in Electro–hydraulic Crushing," Trans. Instn Chem. Engrs, vol.44, 1966.

Andres, "Electrical Disintegration of Rock," Mineral Processing and Extractive Metallurgy Review. 1995, vol. 14, pp. 87–110.

*Primary Examiner*—Mark Rosenbaum
*Attorney, Agent, or Firm*—Don E. Erickson

[57] ABSTRACT

A process and apparatus for comminuting cryogenic feedstock particles, the process comprising the steps of embrittling the particles with a cryogenic medium, positioning the cryogenically embrittled particles in a comminutor having a cavity, the comminutor having means for generating a high-voltage electrical discharge in the cavity, comminuting the particles in the cavity with forces created by the high-voltage electrical discharge pulse, and transferring the comminuted particles from the comminutor and wherein the positioning includes continuously transporting the particles through the comminutor. Transporting of the particles may be accomplished by entraining the particles in the cryogenic medium. The means for generating the forces for comminuting the particles includes generating the high-voltage electrical dischargeacross at least two electrodes. In a second embodiment, the process may include utilization of a cavity which has an axis and at least one focal point on the axis, and wherein the positioning includes positioning the embrittled particles at approximately the focal point. In a third embodiment the cavity is separated into first and second sub-cavities by a diaphragm, the first sub-cavity for receiving the means for generating a high-voltage electrical discharge and the second sub-cavity for receiving the embrittled particles, and wherein the positioning includes positioning the embrittled particles in the second sub-cavity.

18 Claims, 4 Drawing Sheets

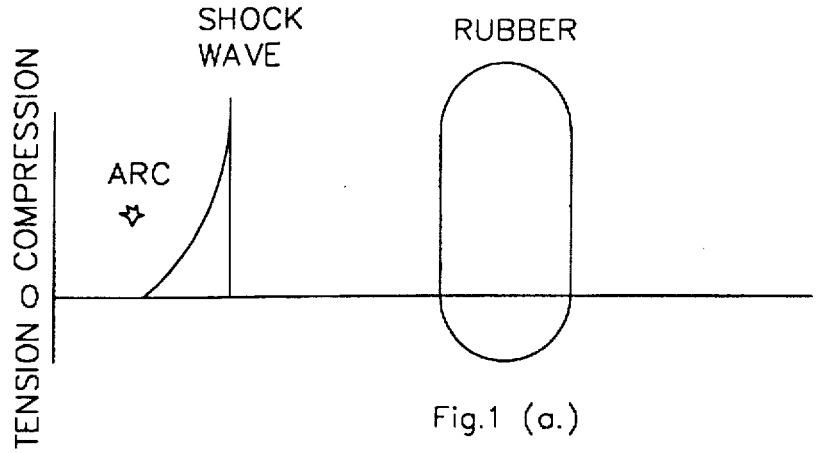
Fig.1 (a.)
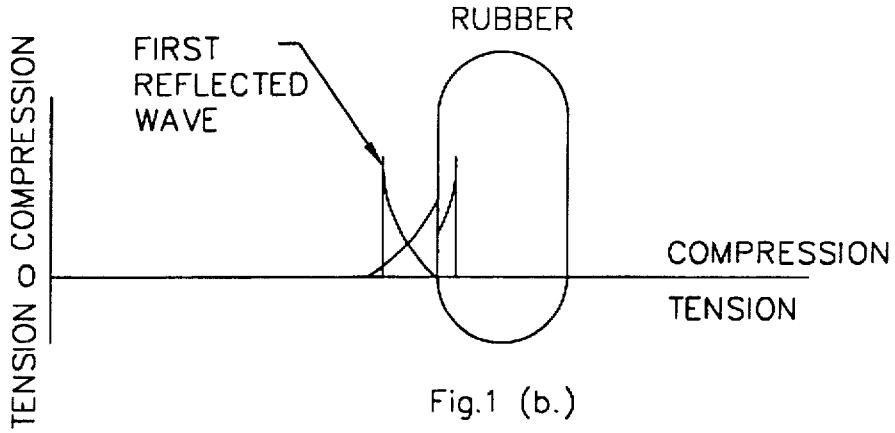
Fig.1 (b.)
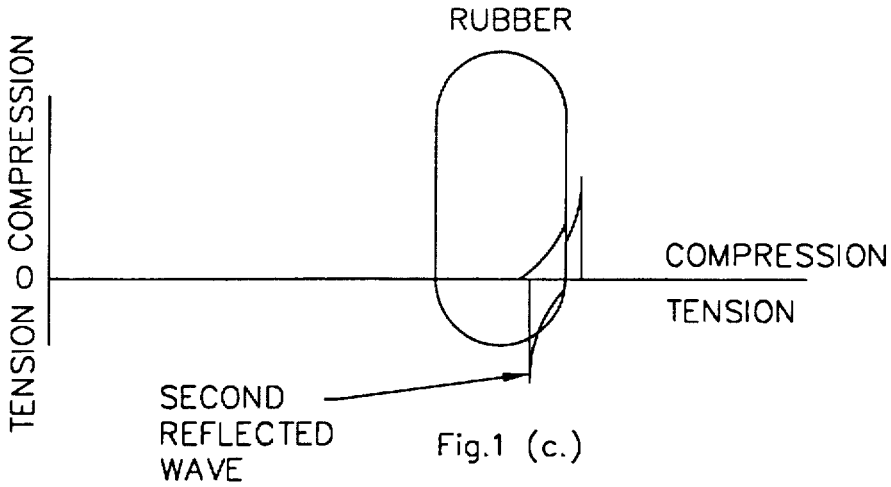
Fig.1 (c.)

COMMINUTION BY CRYOGENIC ELECTROHYDRAULICS

This invention pertains to a method for the comminution of particles, more particularly to the electrohydraulic comminution of cryogenic feed stock particles.

BACKGROUND OF THE INVENTION

The concept of electrohydraulic comminution of brittle materials in water is well known. An electrical potential, high enough to cause electrical breakdown of water, is briefly applied across a pair of submerged electrodes. The rapid energy deposition causes an explosive expansion at the gap and a shock wave that travels outward as shown in FIG. 1*a*. A second shock wave occurs a short time later when the water vapor bubble created at the gap rapidly collapses. Each shock wave travels through the water, passing through any particles in the path. A portion of the wave reflects back as the wave enters the particle due to a difference in acoustic impedance as shown in FIG. 1*b*. A second reflection, shown in FIG. 1*c*, occurs as the wave in the particle hits the back surface of the particle. This reflected wave creates tensile stress in the particle. Since the tensile strength of the particle is typically much lower than its compressive strength, the tensile stress may be sufficient to fracture the particle. The absorption of energy by particles fracturing near the spark gap and by spreading of the wave energy as it travels outward limits the volume over which the shock wave breaks particles.

Maroudas, in a paper titled "Electrohydraulic Crushing" as published in *British Chemical Engineering*, 1967, Vol. 12, No. 4, pp. 558–562 traces the development of electrohydraulic crushing. Carley-Macauley, et al. in a paper titled "Energy consumption in electrohydraulic crushing" as published in *Transactions of the Institute of Chemical Engineers*, 1966, Vol. 44, pp. 395–404 similarly discuss the principles of electrohydraulic comminution.

U.S. Pat. No. 4,313,573 to Goldberger, et al., describes a two step method for separating mineral grains from their ores. First, an electric shock discharges directly through the ore sample producing shock waves emanating from along the discharge path and reflected shock waves (tension waves) from grain boundaries and other discontinuities in the ore. Such waves result in tensile stresses in the ore greater than the strength of the boundary of discontinuity whereby to gross spall the sample generally along the discharge path and to microfracture the region near the discharge path. The second step comprises comminuting the microfractured ore by impact or non-impact means to further reduce the ore generally along microfractures wherein considerably less energy is expended in the second step than would be required to reduce the ore in the same condition without the first step. The second non-impact step is preferably the mechanical application of acoustic energy to the microfractured region of the ore resulting in enlargement of microfractures and subsequent spalling of these microfractured regions.

Andres, U.S. Pat. No. 4,540,127, describes a method and apparatus for crushing materials such as minerals. Lumps of material that are electrically semi-conductive are immersed in water or other high dielectric medium. An electrical discharge occurs between electrodes so arranged that the discharge dissipates in the lump.

Andres, in a paper titled "Electrical Disintegration of Rock" as published in *Mineral Processing and Extractive Metallurgy Review*, 1995, Vol. 14, pp. 87–110 describes the phenomenology related to electrically disintegrating rock.

Shuloyakov, et al., in a paper titled "Electric Pulse Disintegration as a Most Efficient Method for Selective Destruction of Minerals" in the *Proceedings of the XIX IMPC* in Oct. 1995, describes the results of testing at the Russia Institute of High Voltage. These tests showed that liberation yield through electric pulse disintegration was enhanced when compared to mechanical crushing methods for several ores.

Rudashevsky, et al., in a paper titled "Liberation of Accessory Minerals from Various Rock Types by Electric-Pulse Disintegration–method and application", in *Mineral Processing and Extractive Metallurgy*, Jan.–Apr. 1995, discusses results from a laboratory electric pulse disaggregation unit. The results showed that liberation by this method is an efficient method, that the technique has the special advantage that it rapidly liberates mineral grains independent of their size while preserving their original shape, and has the potential for a wide variety of applications.

U.S. Pat. No. 4,721,256 to Lyman discloses the comminution of crushed particles of coal, ores, industrial minerals or rocks by immersing such material in a stream of cryogenic process fluid, such as liquid carbon dioxide, and subjecting the entrained mineral particles to mechanically generated high frequency vibrations. The vibrations of the '256 invention are generated ultrasonically.

Currently, polymer wastes, such as rubber from scrap tires, are shredded to approximately ¼ inch particles. Some processes cryogenically treat the particles and then mechanically crush them using machines such as hammer mills. The current state of the art for polymer waste recycling and particle size reduction prohibits the large scale, cost effective production of particles below 40 mesh.

None of the above references disclose or suggest that the comminution of polymer materials by electrohydraulic means is feasible, nor do such references disclose or suggest that it is feasible to comminute any materials entrained in cryogenic streams by pulsing with high voltage electricity. It is not obvious that an electrical pulse discharge in cryogenic fluid generates a significant shock wave since the liquid is at or near its boiling point and the evaporation of fluid at the point of discharge is an important aspect of the electrohydraulic process. Neither is it apparent that the strength of any such shock wave is sufficient to cause fracture in a cryogenic feed stock particle since the particle exhibits increased strength at cryogenic temperature and at the high rate of loading provided by the shock wave.

SUMMARY OF THE INVENTION

The present invention generally pertains to a process and apparatus for the comminution of materials such as plastics, polymers, resins, gum, hardwood spices and other similar materials that become embrittled solely at temperatures below 0° C. (all such materials hereinafter referred to for the purposes of this invention as "cryogenic feed stock"), and more particularly to a process and apparatus for electrohydraulically comminuting cryogenic feed stock, and specifically to the continuous electrohydraulic comminution of cryogenic feed stock in a cryogenic medium.

As discussed above, the purpose of electrohydraulic comminution is the production of fine particle size product from gross sized feed stock. Electrohydraulic comminution is effected by submerging the particle in an aqueous solution, then spalling the selected particle by subjecting it to a shock wave created by an electrical discharge. This invention applies the electrohydraulic comminution concept to the comminution of embrittled cryogenic feed stock. Although the invention applies to all cryogenic feed stock, the reduction to practice of the invention was accomplished using rubber particles and the embodiments set forth below will describe the electrohydraulic comminution of rubber particles. Since spark and shock wave generation require a liquid dielectric medium, an immersion of rubber particles in cryogenic nitrogen is typically used to embrittle the rubber. Liquid nitrogen is the prime candidate for the electrohydraulic liquid.

Electrical and thermodynamic fluid properties of the cryogenic fluid are critical to the viability of this process. The applied voltage must be greater than the dielectric breakdown strength of the fluid. The electrical resistance of the fluid (before breakdown) must also be high enough to limit slow energy dissipation while the voltage level builds up. Important fluid thermodynamic properties include the specific heat of the liquid, the heat of vaporization, and fluid and vapor densities. Table 1 lists some of these values for nitrogen.

The electrical breakdown strength of liquid nitrogen is a function of hydrostatic pressure, chemical purity, electric pulse width, and pulse polarity. Thermally induced bubbles in the nitrogen also influence the electrical breakdown strength. Polymer particles in the fluid reduce the dielectric strength.

TABLE 1

Properties of Nitrogen

| Property | Value | Units | Conditions/Comment |
|---|---|---|---|
| melting point | 63.2 | K. | melting point |
| heat capacity | 25.7 | J/g | |
| boiling point | 77.5 | K. | boiling point, 1 atm |
| specific volume, sat liquid | 0.001237 | m^3/kg | 77.347 K., 0.101325 MPa |
| specific volume, evap | 0.215504 | m^3/kg | 77.347 K., 0.101325 MPa |
| specific volume, sat vapor | 0.216741 | m^3/kg | 77.347 K., 0.101325 MPa |
| enthalpy, sat liquid | −121.433 | kJ/kg | 77.347 K., 0.101325 MPa |
| enthalpy, evap | 198.645 | kJ/kg | 77.347 K., 0.101325 MPa |
| enthalpy, sat vapor | 77.212 | kJ/kg | 77.347 K., 0.101325 MPa |
| entropy, sat liquid | 2.839 | kJ/kg-K. | 77.347 K., 0.101325 MPa |
| entropy, evap | 2.5706 | kJ/kg-K. | 77.347 K., 0.101325 MPa |
| entropy, sat vapor | 5.4096 | kJ/kg-K. | 77.347 K., 0.101325 MPa |
| specific volume, sat liquid | 1.239 | cc/gm | 77.38 K., 1 atm |
| compressibility factor, sat liquid | 0.005468 | | 77.38 K., 1 atm |
| specific volume, sat vapor | 216.8 | cc/gm | 77.38 K., 1 atm |
| compressibility factor, sat vapor | 0.9567 | | 77.38 K., 1 atm |
| sound velocity, sat liquid | 857.1 | m/sec | 77.5 K., 1 atm, 528.58 kc/sec |
| sound velocity, sat liquid | 942.4 | m/sec | 77.07 K., 102.3 kPa |
| dielectric constant | 1.454 | | −203 C. |
| dielectric temp coeff | 2.90E + 01 | 1/C. | −210 to −195 C. |
| heat of fusion | 1.72E + 02 | cal/mole | freezing point |
| heat of vaporization | 1.34E + 03 | cal/mole | boiling point |
| vapor pressure | 1.00E + 02 | mm Hg | melting point |
| temp at 1 atm vapor pressure | −1.96E + 02 | C. | 1 atm |
| surface tension, vapor | 8.27E + 00 | dynes/cm | −183 C. |
| viscosity, vapor | 1.56E + 02 | micropoise | −21.5 C. |
| dielectric strength | 2250 | kV/cm | 0.5 μs pulse, 1 atm, high purity |
| dielectric strength | 500 | kV/cm | 1.0 μs pulse, 1 atm, commercial purity |

TABLE 2

Properties of Rubber

| Property | Value | Units | Conditions/Comment |
|---|---|---|---|
| density | 1.07 | gm/cc | butyl |
| velocity of sound, long wave | 1830 | m/sec | butyl, room temp |
| density | 0.95 | gm/cc | gum |
| velocity of sound, long wave | 1550 | m/sec | gum, room temp |
| density | 1.33 | gm/sec | neoprene |
| velocity of sound, long wave | 1600 | m/sec | neoprene, room temp |
| dielectric constant | 2.8 | none | hard rubber, room temp |
| dielectric strength | 470 | volts/mil | hard rubber, room temp |
| volume resistivity | 2.00E + 15 | ohm-cm | hard rubber, room temp |
| loss factor = power factor x | 0.06 | none | hard rubber, room temp |
| dielectric constant | 3 | none | chlorinated rubber room temp |
| volume resistivity | 1.50E + 13 | ohm-cm | chlorinated rubber room temp |

TABLE 2-continued

| Properties of Rubber | | | |
|---|---|---|---|
| Property | Value | Units | Conditions/Comment |
| loss factor = power factor x | 0.006 | none | chlorinated rubber room temp |
| dielectric constant | 2.55 | none | isomerized rubber room temp |
| dielectric strength | 620 | volts/mil | isomerized rubber room temp |

Table 2 lists pertinent properties of rubber. Table 3 lists cryogenic ultimate strength and elongation at rupture parameters for various other polymers. The tensile strength of cryogenic polymers is a function of material type, temperature, and rate of load application. All references report that the tensile strengths of polymers increase with a decrease of temperature. At a glass transition temperature $T_g$ (−24° C. for nitrile to −134° C. for silicone for very slow deformation rates), rubber reaches the glassy state. As the temperature drops below its glass transition temperature, rubber becomes brittle and fractures rather than undergoing nonlinear deformation. Ruptures occurring at low strains of approximately 10% have been reported.

TABLE 3

Strengths & Elongation of Cooled Polymers

Polymer Properties at 77 K. (from Hartwig)

| Polymer | Ultimate Tensile Strength $\sigma_{ult}$ (MPa) | Elongation $\epsilon$ (%) |
|---|---|---|
| HDPE | 153 | 4.0 |
| PTFE | 77 | 1.6 |
| PEEK | 192 | 5.5 |
| PS | 57 | 2.0 |
| PSU | 130 | 7.0 |
| PC | 156 | 6.0 |
| PEI | 157 | 5.2 |
| PAI | 150 | 3.2 |
| EP I & II | 150 | 3.1 |

BRIEF DESCRIPTION OF THE DRAWINGS

FIG. 1 is a graphic depicting electric shock wave dynamics.

DETAILED DESCRIPTION

First Preferred Embodiment

Figure 2:
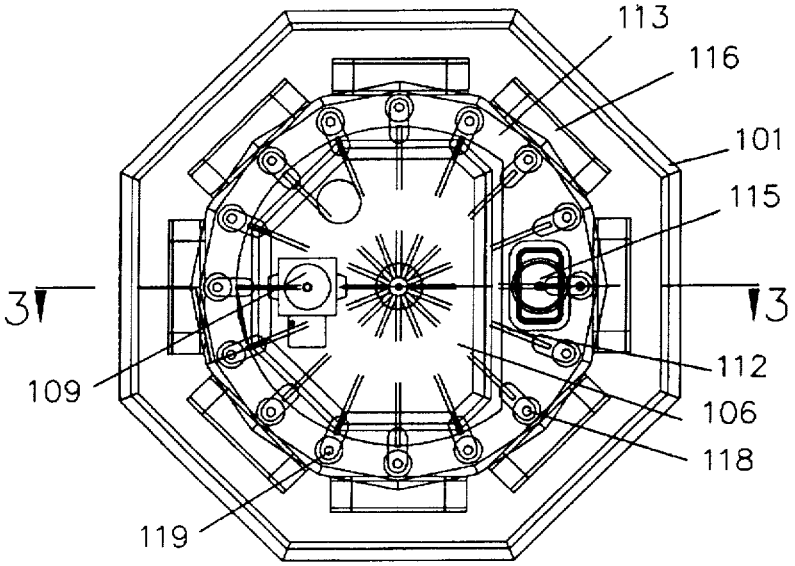
FIG. 2 is a plane view of a comminution chamber of an embodiment of the invention.
Figure 3:
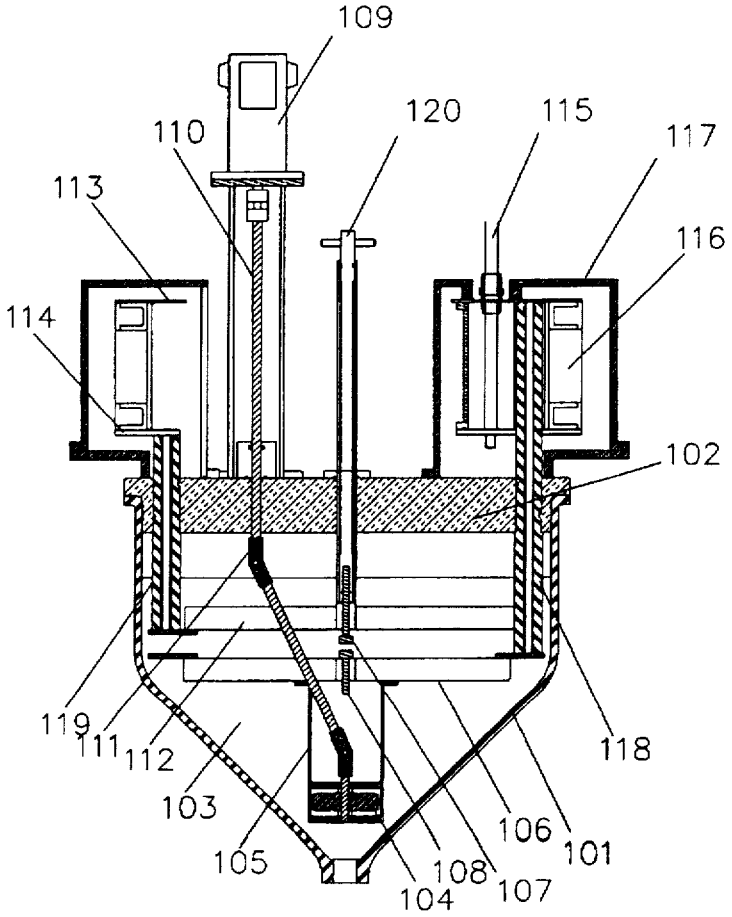
FIG. 3 is a cross-sectional view of the chamber of FIG. 2 along section line 3—3.

One embodiment of a comminution chamber of the invention having a cavity for comminuting feed particles will be described while concurrently referring to FIGS. 2 and 3. A conical inner chamber 101, surrounded by thermal insulation (not shown), and covered by lid 102 contains a slurry 103 of liquid nitrogen and feed particles retained by a valve (not shown) at the bottom of the chamber. The slurry entrains clean rubber feed particles ranging in size from ¼ inch chips to 40 mesh crumb in cryogenic liquid nitrogen. As a result of the particle heat transfer to the liquid nitrogen, the particles are embrittled. Particles from the bottom of the chamber cavity 101 are propelled by propeller 104 through duct 105 and past web 106 into the region of electrodes 107, 108. Propeller 104 is powered by motor 109 through connecting drive shaft 110 and universal joints 111. Webs 106, 112 serve dual purposes as structure supporting electrodes 107, 108 and as electrically conducting buswork between the rings 113, 114 and the electrodes 107, 108. Thermal insulation could be provided by chamber wall material, additional insulation material, evacuated space outside the chamber, or other insulation methods.

A high voltage (on the order of 150,000 volts), short duration (on the order of 100 nanoseconds) electrical pulse is applied via input coaxial cable 115 to the charged ring 113 and the ground (return) ring 114. Many alternative methods, familiar to those knowledgeable in the art of pulse power, could be used to generate the input electrical pulse, including Marx circuits, pulse forming networks, and pulse transformers. The electrical pulse charges capacitors 116 between the rings 113, 114. The rings 113, 114 electrically connect the capacitors 116 in parallel. The capacitors 116 and rings 113, 114 are arranged about the centerline within housing 117 which is filled with electrically insulating gas or liquid such as sulfur hexaflouride or transformer oil. The insulation prevents the high voltage developed across the capacitors from arcing or otherwise dissipating. A difference in electrical potential across the charged capacitors 116 is applied through the set of insulated conducting rods 118, 119 and conducting webs 112, 106 to electrodes 107, 108 respectively. The transfer capacitor 116 has a capacitance on the order of 100 nanoFarads. Inductance between the transfer capacitor 116 and electrodes 107, 108 is on the order of 100 nanoHenrys. The physical arrangement of the capacitors 116, conducting rods 118, 119, and conducting webs 112, 106 is such as to reduce inductance thereby narrowing the electrical pulse. The gap between electrodes 107 and 108 can be adjusted externally via extension rod 120. When a sufficient difference of electrical potential is achieved for a sufficient duration of time at the transfer capacitor 116 and electrodes 107, 108, the liquid nitrogen 103 breaks down electrically. Resistance between the electrodes 107, 108 drops and high current passes through the liquid nitrogen. The joule heating of the liquid nitrogen 103 results in a rapidly expanding vapor or gas cavity between the electrodes 107, 108. A shock wave is thereby generated that travels outward through the liquid nitrogen. When the shock wave encounters a particle, the particle fractures, spalling off smaller product particles. The process is repeated until the desired degree of comminution is achieved. The product particles may then be removed via a valve (not shown) at the bottom of the chamber. The difference in electrical potential may be achieved by connecting one of the electrodes to the ground side of the transfer capacitor and the other electrode to the high voltage side of the transfer capacitor.

In this exemplary embodiment and each of the following embodiments, liquid nitrogen is the fluid selected to embrittle the cryogenic feed stock. However, alternative fluids, such as liquid propane, liquid carbon dioxide, liquid helium, or other cryogenic fluids may be selected for such purpose. Likewise, the buswork in this and following embodiments is selected to minimize any negative effect of inductance between the transfer capacitor and the electrodes on the electrical pulse shape. Other buswork architectures could be selected, however, as well as other capacitance levels and charge voltages. For example, a switch could be interposed between the transfer capacitor and the electrodes to control electrode voltage and gap independently and enable overvoltaging, but probably at the expense of higher inductance. A wide variety of electrode shapes could also be used, such as points, planes, and hemispheres. Alternative methods of transporting the cryogenic feed stock into the effective shock wave region such as sinking could be selected.

Second Preferred Embodiment

Figure 4:
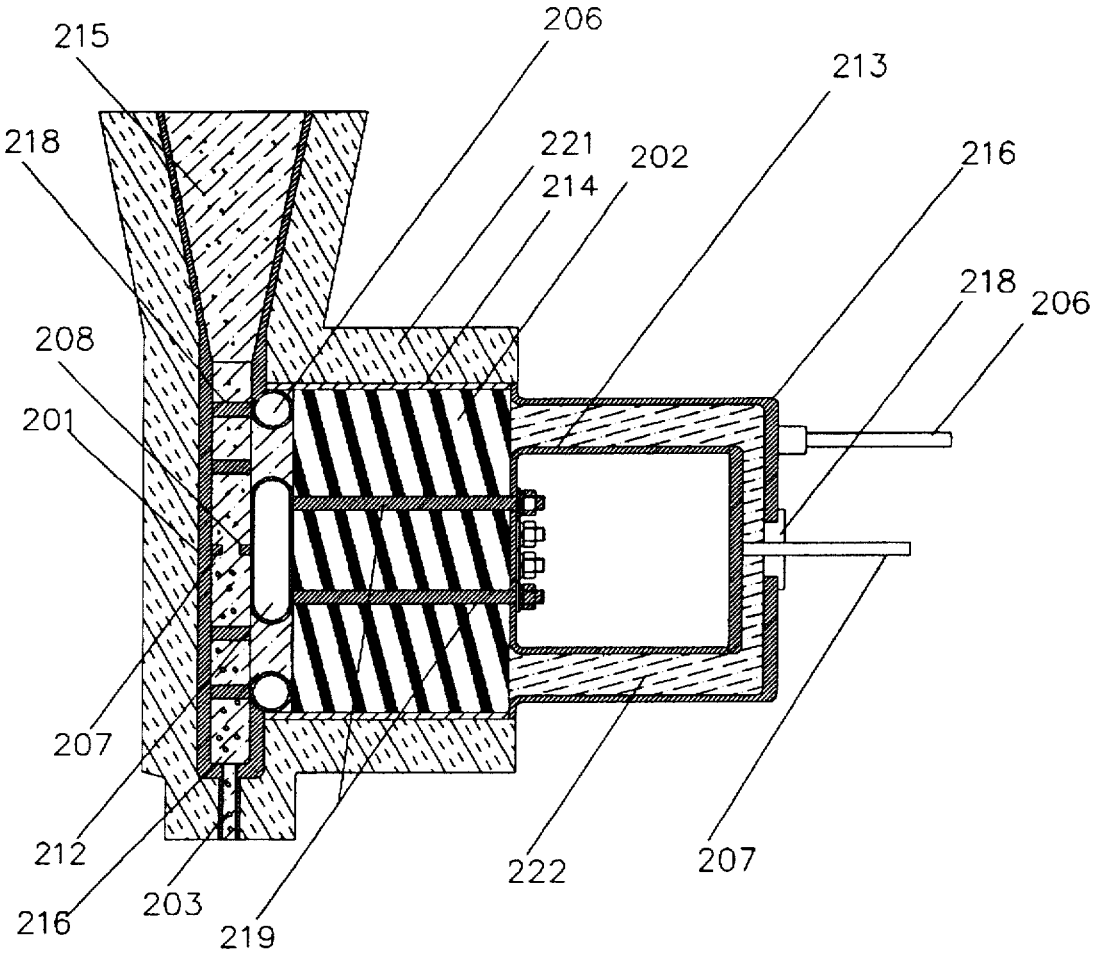
FIG. 4 is a cross-sectional view of another embodiment of the comminution chamber.

A second preferred embodiment of the invention will be described while referring to FIG. 4. A slurry as described in the first embodiment contains feed particles 203 for comminution in this exemplary embodiment. The slurry is transported through a vertically oriented comminution chamber cavity 201 using pressure from the liquid nitrogen supply. The comminution chamber cavity 201 is insulated from ambient temperature by thermal insulation 221. The comminution chamber cavity 201 widens as the flow passes up through it causing the fluid velocity to decrease. Since the particle buoyancy and particle drag due to the fluid flow rate above the chamber is insufficient to overcome the weight of the particles, the feed particles 203 are trapped in the comminution chamber cavity 201.

In the comminution chamber cavity 201, a pair or pairs of electrodes 207, 208 are located in the flowpath of feed particles 203. The ground electrode 207 is electrically connected to the chamber cavity 201 which is in turn connected by a number of rods 218 arranged coaxially through toroid field shaper 206 and conductive cylinder 214 to the ground of a transfer capacitor 216 located outside the flow. The second electrode 208 is connected through field shaper 212 to the negative side of the transfer capacitor 213 through a second set of rods 219 arranged coaxially to conductive cylinder 214. The rods 219 pass through a plastic insulator 202 that functions both as an electrical insulator between the rods 219 and conductive cylinder 214 and as a thermal insulator between the cryogenic comminution chamber cavity 201 and outside ambient temperature. In this exemplary embodiment, the transfer capacitor 213, 216 is of the water capacitor type, familiar to those knowledgeable in the art of pulse power. A charged cylinder 213 and a coaxial ground cylinder 216 form an annulus filled with water 222. A high voltage, short duration pulse is applied to the transfer capacitor 213, 216 through connection 207 which is electrically insulated from ground cylinder 216 by insulator 218. Return current flows out through connection 206. As in the first embodiment, the liquid nitrogen 216 breaks down electrically resulting in a shock wave that fractures particles in the region of electrodes 207, 208. Particles 215 that are small enough are carried up and away by the fluid flow. Those that are too large to be carried away remain in the comminution chamber awaiting the next shock wave.

Third Preferred Embodiment

Figure 5:
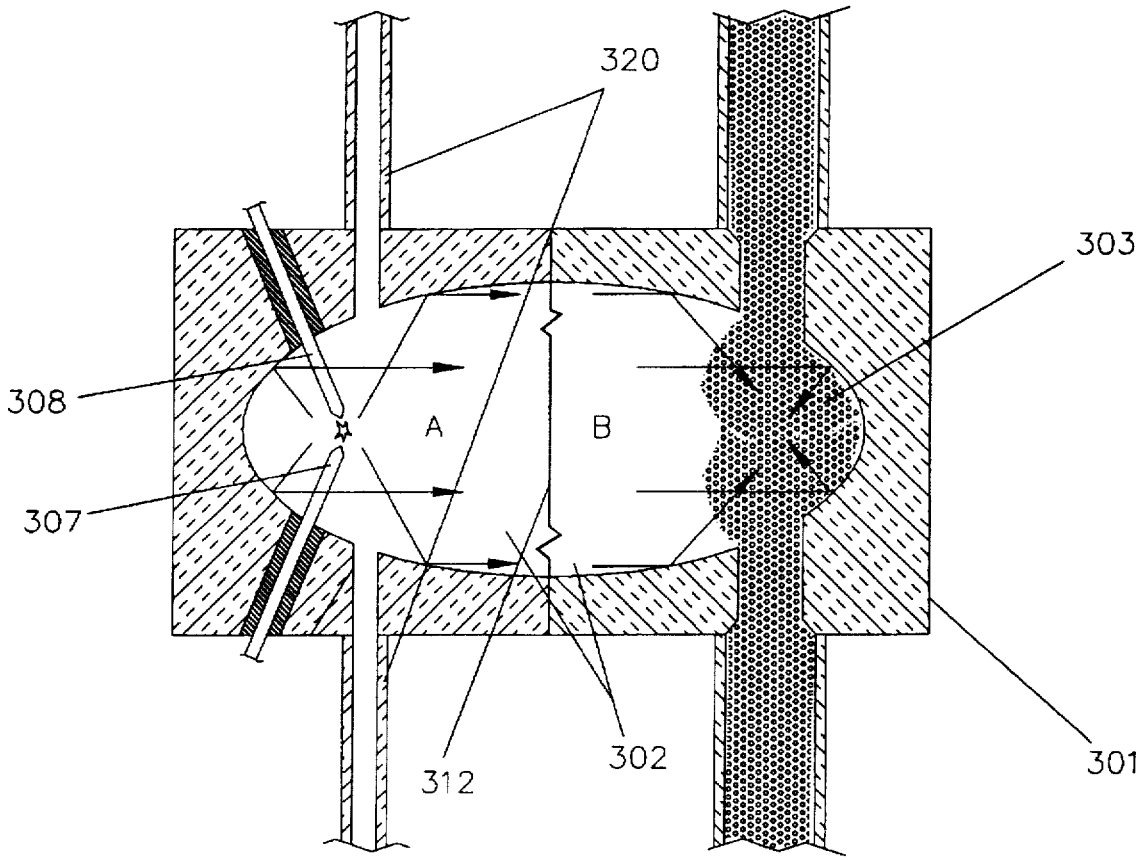
FIG. 5 is a cross-sectional view of a comminution chamber with an isolated shock chamber.

A third preferred embodiment of the invention will be described while referring to FIG. 5. The comminution chamber, shown in a cutaway view, comprises an outer chamber 301, and inner chamber cavity 302, and fill/drain ports 320. Inner chamber cavity 302 is of generally ellipsoidal shape and contains a flexible diaphragm 312 which sealably bisects the inner chamber cavity 302 into separate chamber cavities 302A and 302B. A pair of electrodes 307, 308 is disposed within the inner chamber cavity 302A. Chamber cavity 302A is filled with an alternative fluid, such as another cryogenic liquid. Electrode 307 is electrically connected by means of a high voltage coaxial cable to a source of high voltage electrical pulse as described in the previous embodiments.. Electrode 308 is at ground potential. The inner chamber cavity 302B is substantially filled with liquid nitrogen entrained with embrittled rubber particles 303. As the embrittled particles are transported through the comminution zone of inner chamber cavity 302B, the electrodes 307, 308 are pulsed as in the previous embodiments. The shock waves radiating from the gap between electrodes 307, 308 are then reflected by the walls of the inner chamber through the flexible diaphragm 312 into the inner chamber cavity 302B. Further reflections from the walls of inner chamber cavity 302B focus the shock waves on the entrained particles, effectively comminuting the particles. The comminuted particles are then transported out of the comminution zone to be separated from the feed particles. U.S. Pat. No. 4,676,853 to Lerma describes a flexible diaphragm which would be suitable for the extreme cryogenic temperatures. Although this embodiment employs an ellipsoidally shaped chamber, other chamber shapes could be used to reflect and refocus the shock waves in the area of the cryogenic feed stock. The invention described herein is not limited to the shape of the chamber, nor whether or not the comminution chamber is asymmetrical or symmetrical. In those embodiments where focusing the shock waves is advantageous it is only necessary that one be able to accurately predict a focal point of the cavity of the chamber. The invention is not limited if there is only one focal point, as where the cavity of the chamber is spherical. In such case, the electrodes may be placed at the center of the sphere and the shock wave would then comminute the particles in the area of the electrodes.

Similarly, there are no limitations on the means by which feed particles may be transported through the comminution chamber. In some embodiments it may be most efficient to utilize gravitational flow from a feed hopper placed substantially vertical over the comminution chamber, and in other embodiments, a conveyor mechanism may be employed.

The invention is not limited by the manner in which electrical pulses are generated to produce shock waves. Although the embodiments of the invention describe the use of capacitors for the generation of electrical pulses, other means of generation of electrical pulses may be employed.

While the present description contains many specificities, these should not be construed as limitations on the scope of the invention, but rather as an exemplification of one/some preferred embodiment/s thereof. Accordingly, the scope of the invention should not be determined by the specific embodiment/s illustrated herein, but the full scope of the invention is further illustrated by the claims appended hereto.

We claim:

1. A process for comminuting cryogenic feedstock particles, the process comprising the steps of:

(a) embrittling the particles with a cryogenic medium;

(b) positioning the cryogenically embrittled particles in a comminutor having a cavity, the comminutor having means for generating a high-voltage electrical discharge in the cavity;

(c) comminuting the particles in the cavity with forces created by the high-voltage electrical discharge pulse; and (d) transferring the comminuted particles from the comminutor.

2. The process of claim 1 wherein the positioning of step (b) includes continuously transporting the particles through the comminutor.

3. The process of claim 2 wherein transporting of particles is accomplished by entraining the particles in the cryogenic medium.

4. The process of claim 1 wherein the means for generating the high-voltage electrical discharge includes at least two electrodes and an electrical source capable of generating a difference in electrical potential across the electrodes.

5. The process of claim 1 wherein the cavity has an axis and at least one focal point on the axis, and wherein the positioning of step (b) includes:

(i) positioning the embrittled particles at approximately the focal point.

6. The process of claim 1 wherein the cavity is separated into first and second sub-cavities by a diaphragm, the first sub-cavity for receiving the means for generating a high-voltage electrical discharge and the second sub-cavity for receiving the embrittled particles, and wherein the positioning of step (b) includes:

(i) positioning the embrittled particles in the second sub-cavity.

7. The process of claim 6 wherein the positioning of step (b) includes continuously transporting the particles through the second sub-cavity.

8. The process of claim 7 wherein transporting of particles is accomplished by entraining the particles in the cryogenic medium.

9. The process of claim 6 wherein the cavity has an axis and at least two foci, the diaphragm separating the first and second sub-cavities at a point along the axis, each sub-cavity having at least one focal point therewithin, and wherein the positioning of step (b) includes:

(i) positioning the particles at approximately the focal point in the second sub-cavity.

10. The process of claim 9 wherein the positioning of step (b) includes continuously transporting the particles through the second sub-cavity.

11. The process of claim 10 wherein transporting of particles is accomplished by entraining the particles in the cryogenic medium.

12. A process for comminuting cryogenic feedstock particles, the process comprising the steps of:

(a) embrittling the particles with a cryogenic medium;

(b) positioning the cryogenically embrittled particles in a comminutor having a cavity, the cavity separated into first and second sub-cavities by a diaphragm, the first sub-cavity having at least two electrodes, the at least two electrodes spaced to enable a high-voltage electrical discharge pulse across the electrodes, the second sub-cavity having means to position the particles to receive the high-voltage electrical discharge pulse;

(c) comminuting the particles with forces created by the high-voltage electrical discharge pulse; and (d) transferring the comminuted particles from the second sub-cavity.

13. The process of claim 12 wherein the cavity has an axis and at least two foci on the axis, the diaphragm separating the first and second sub-cavities at a point along the axis, each sub-cavity having a at least one focal point therewithin, and wherein the positioning of step (b) includes:

(i) positioning the at least two electrodes at approximately the at least one focal point in the first sub-cavity; and (ii) positioning the particles at approximately the at least one focal point in the second sub-cavity.

14. The process of claim 13 wherein the positioning of step (b) includes continuously transporting the particles through the second sub-cavity.

15. The process of claim 14 wherein transporting of particles is accomplished by entraining the particles in the cryogenic medium.

16. An apparatus for the comminution of cryogenic feedstock particles, the apparatus comprising:

(a) a chamber defining a cavity for receiving cryogenically embrittled particles, the chamber comprising a thermally insulated vessel having a cavity therewithin, the cavity having an axis and at least one focal point on the axis, the cavity separated into first and second sub-cavities by a diaphragm, the first sub-cavity for receiving first and second electrodes disposed within the cavity, the second sub-cavity for receiving the particles;

(b) an inlet port communicating with the cavity of the vessel, the inlet port for transporting the embrittled particles into the cavity;

(c) an outlet port communicating with the cavity of the vessel, the outlet port for transporting comminuted particles from the cavity:

(d) an elutriating flow column for positioning the embrittled particles within the cavity at the at least one focal point in the cavity; and (e) an electrical source for generating forces to comminute the embrittled particles, the electrical source connected to the first electrode, the electrical source for generating a different electrical potential between the first electrode and the second electrode.

17. The apparatus of claim 16 wherein the cavity of the thermally insulated vessel has an axis and at least two foci at points on the axis, the diaphragm separating the first and second sub-cavities at a point along the axis, each sub-cavity having at least one focal point therewithin, and wherein;

(i) the electrodes are positioned at approximately the focal point in the first sub-chamber; and (ii) the inlet and outlet ports communicate with the focal point of the second sub-cavity.

18. The apparatus of claim 17 wherein the electrical source includes a capacitor.

* * * * *